United States Patent [19]

Lo

[11] 4,384,266

[45] May 17, 1983

[54] FUSE APPARATUS

[75] Inventor: Christopher C. Lo, Whitehall, Ohio

[73] Assignee: Bell Telephone Laboratories, Incorporated, Murray Hill, N.J.

[21] Appl. No.: 332,555

[22] Filed: Dec. 21, 1981

[51] Int. Cl.[3] ..... H01H 85/30

[52] U.S. Cl. ..... 337/244; 337/241

[58] Field of Search ..... 337/241, 242, 243, 244, 337/265, 267

[56] References Cited

U.S. PATENT DOCUMENTS

| | | | |
|---|---|---|---|
| 3,450,949 | 6/1969 | Inglis | 337/244 X |
| 3,483,502 | 12/1969 | Mikulecky | 337/244 |
| 4,085,396 | 4/1978 | Augis et al. | 337/290 |

FOREIGN PATENT DOCUMENTS

| | | | |
|---|---|---|---|
| 1920825 | 11/1970 | Fed. Rep. of Germany | 337/244 |

*Primary Examiner*—George Harris

*Attorney, Agent, or Firm*—D. A. Marshall

[57] ABSTRACT

An alarm indicator fuse (1) for large current and high temperature applications. The fuse assembly comprises apparatus (16, 121, 162) slidably engaging alarm indicator apparatus (14, 15) coupled between one conducting member (12) and a fuse element (13) electrically connected to another conducting member (11) to electrically couple the fuse element to the one conducting member and enable release of the alarm indicator apparatus upon opening of the fuse element. The electrically coupling and release enabling apparatus shortens the current path of the fuse between the electrical conducting members to increase the current capacity and improve the temperature characteristics of the fuse.

13 Claims, 5 Drawing Figures

FIG. 1
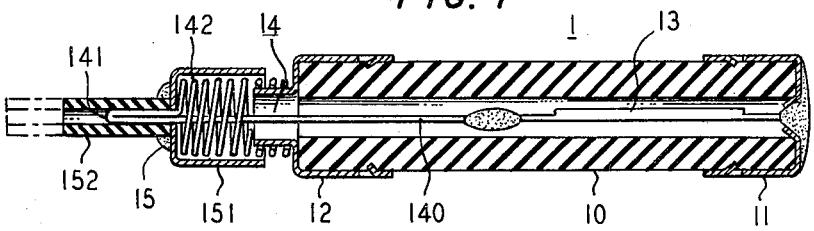
FIG. 2
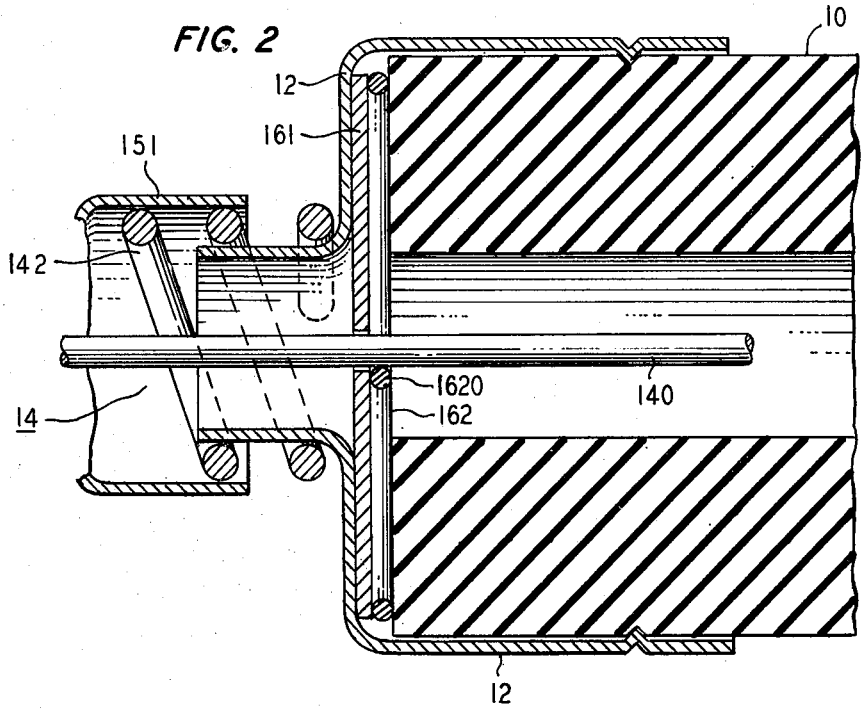
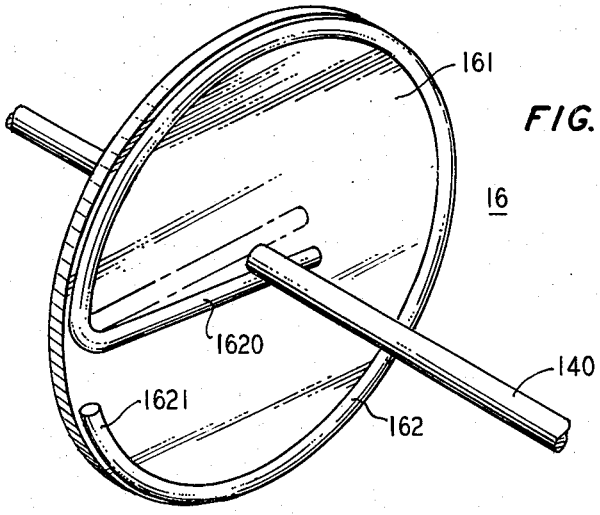
FIG. 3

FUSE APPARATUS

TECHNICAL FIELD

This invention relates to electrical fuses. In particular it relates to electrical fuses designed for visibly indicating failure of the fuse.

BACKGROUND ART

Fuses have found wide applications in industry and the home and are designed to prevent an excessive overload of current from damaging electrical equipment. In the most basic form an electrical fuse comprises a fusible link or fuse element connected between electrical conducting members which are intended to be inserted in series with the circuit serving the electrical equipment. In operation the fuse element functions in response to an excessive amount of current by opening the circuit to prevent damage of the equipment.

More advanced types of fuses have mechanical operating apparatus combined with fuse elements to effect the opening of a protected electrical circuit. For example, one such type of fuse device utilizes a disk contact structure to open the electrical circuit. The disk contact is controlled by the melting and voluminous expansion of a temperature sensitive member responding to an excessive amount of electrical current. Other types of fuse devices employ spring apparatus in combination with a fuse element to form a contact structure that operates to open the protected circuit when excessive current melts the fuse element. A problem with these types of fuse devices is that the mechanical operating apparatus and fuse elements are positioned within an electrical conducting casing or housing that prevents a visual inspection as to the operative or inoperative state of the fuse.

Alarm indicating fuses have been disclosed in the prior art and are designed to provide a visual indication when the fuse element operates to open the protected electrical circuit. Such a fuse device typically comprises a pair of electrical conducting members each located on the end of an insulative housing having a fuse element positioned therein. The fuse element coupled to one of the electrical conducting members is connected through a spring member located outside the insulative housing to the other electrical conducting member. An electrical path extends from the one electrical conducting member through the fuse element and spring member to the other electrical conducting member. Excess current flowing through the path opens the fuse element to interrupt the protected electrical circuit and release the spring member to visibly indicate the inoperative state of the fuse. A problem arises with this type of fuse device in that the conducting spring member adds resistance in the electrical path and increases the temperature of the fuse device thereby limiting use to specific applications.

Accordingly, a need exists for an alarm indicating fuse for both low and high current electrical circuit applications. A need also exists for an alarm indicating fuse designed to both lower the resistance of the electrical path and the total wattage output of the fuse to thereby improve use for both low and high current circuit applications.

SUMMARY OF THE INVENTION

The foregoing problems are solved and a technical advance is achieved by an alarm indicating fuse having apparatus slidably engaging an alarm indicator to electrically couple a fuse element between electrical conducting members and to enable release of the alarm indicator upon the opening of the fuse element. The fuse comprises a pair of electrical conducting members one of which is connected to a fuse element coupled to alarm apparatus coupled to the other electrical conducting member. Apparatus of the fuse slidably engages the alarm apparatus to both electrically couple the fuse element to the other electrical conducting member and to enable the release of the alarm apparatus upon opening of the fuse element.

In accordance with the invention, a fuse comprising an insulating housing with a pair of electrical conducting ferrules each secured to one end of the housing has a fuse element that is positioned in the housing and which is electrically coupled at one end with one of the ferrules. A spring member having a shank coupled to the other end of the fuse element is extended along the centerline of the housing through the second ferrule and formed by a reverse bend into a pretensioned spring engaging the second ferrule. Alarm indicator apparatus having a cap formed to receive the pretensioned spring and a stem attached to the reverse bend of the spring member is provided to visually indicate failure of the fuse. The fuse apparatus includes an electrical conducting disk member that is disposed in the housing adjacent to the second ferrule and which slidably supports the spring member shank along the centerline of the housing. An electrical conducting loop spring member positioned in the housing adjacent to the disk member has a free end extended radially outward from the center and formed along the circumference of the disk member where it is attached at the end thereto to pretension the free end in engagement with the shank of the spring member. The electrical conducting loop spring and disk members slidably engage the spring member shank to electrically couple the fuse element to the second ferrule and enable release of the spring member upon opening of the fuse element to cause the alarm indicator to denote failure of the fuse.

Also in accordance with the invention, a fuse comprising an insulating housing has a fuse element positioned in the housing along with a spring member having a shank coupled to one end of the fuse element. The spring member shank extends along the centerline of the housing and is formed through a reverse bend into a spring having coils which enclose a portion of the shank. A first electrical conducting ferrule coupled with the fuse element is secured to one end of the housing. A second electrical conducting ferrule secured to the other end of the housing has a stem portion extended outward from the housing along the centerline thereof and is formed with an outer surface for engaging the coils and pretensioning the spring section of the spring member. The stem portion is drilled and sized to slidably support the shank of the spring member along the centerline of the housing. An electrically conducting planar loop spring member having a radial end extended across the spring member shank at a right angle thereto is formed into a circular loop disposed in the housing adjacent to and in engagement with the second ferrule to pretension the radial end into slidable engagement with the spring member shank to both electrically couple the fuse element to the second ferrule and enable release of the spring member upon opening of the fuse element.

DESCRIPTION OF THE DRAWING

The foregoing as well as other objects, features and advantages of the invention will be more apparent from a description of the drawing in which:

FIG. 1 is a cross section view of an alarm indicating fuse;

FIG. 2 is a fragmentary cross-sectional view showing a first embodiment of a fuse incorporating the principles of the invention;

FIG. 3 is a prospective view of the electrically coupling and alarm release enabling apparatus of the fuse set forth in FIG. 2;

DESCRIPTION OF THE INVENTION

1. Apparatus Description

Figure 4:
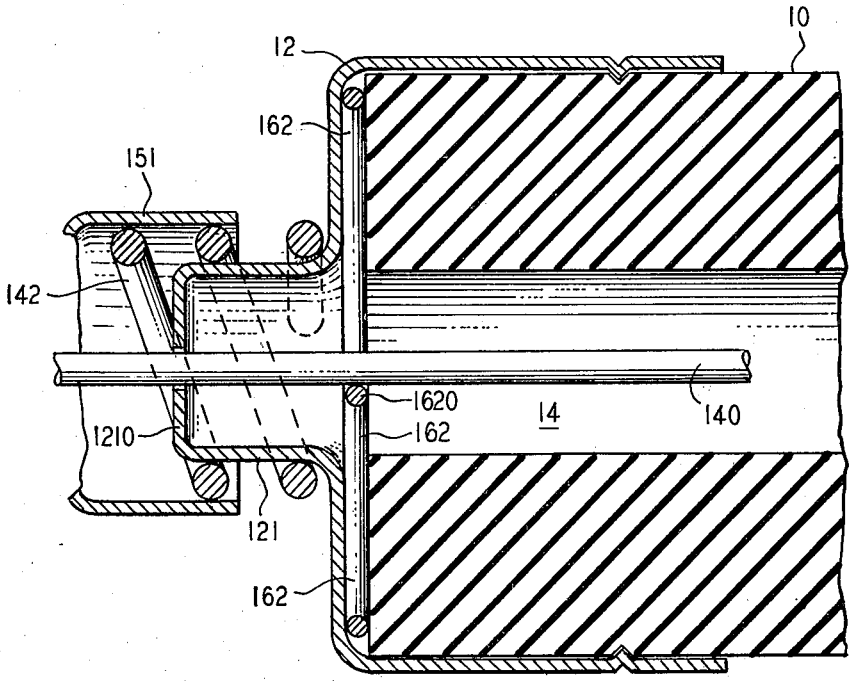
FIG. 4 is a fragmentary cross-sectional view illustrating a second embodiment of a fuse incorporating the principles of the invention.
Figure 5:
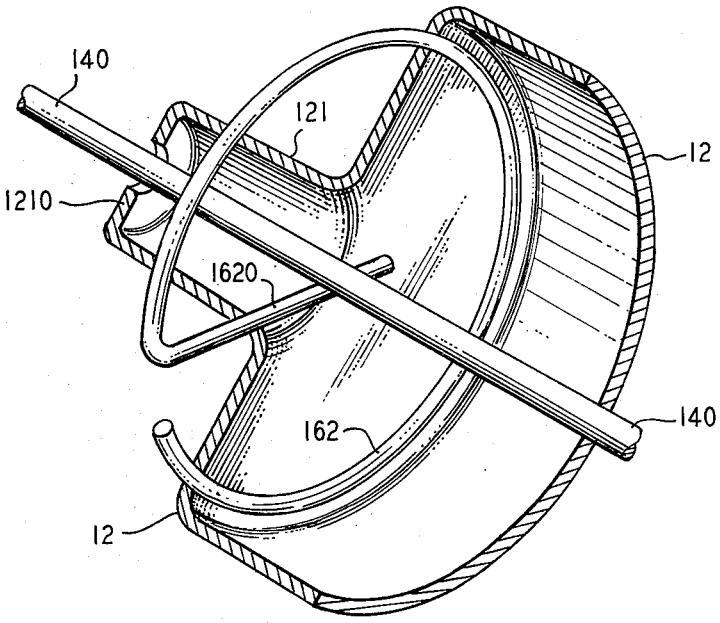
FIG. 5 is a prospective view of the electrically coupling and alarm release enabling apparatus of the fuse set forth in FIG. 4.

Referring to the drawing and more specifically to FIG. 1 of the drawing, alarm indicator fuse 1 set forth therein is intended for use in electrical circuits to protect equipment from being damaged from an excessive amount of current. Fuse 1 comprises an insulating casing or housing 10 provided with a pair of electrical conducting end members 11 and 12 which serve as terminals hereinafter referred to as ferrules. A fuse element 13 electrically coupled to ferrule 11 is positioned within insulating housing 10 and is connected at one end by any one of a number of well-known methods to shank 140 of metallic spring member 14. Shank 140 extends along the centerline of housing 10 through ferrule 12 and is formed through a reverse bend section 141 into a pretensioned spring 142 having coils partially enclosing shank 140 and engaging ferrule 12.

Alarm indicator apparatus 15 having a cap 151 formed to receive the coils of pretensioned spring 142 includes a stem 152 attached to the reverse bend 141 of spring member 14. As long as fuse element 13 is intact, pretensioned spring 142 is under compression thereby maintaining alarm indicator apparatus 15 in a normal state.

Referring now to FIG. 3 of the drawing, the electrically coupling and release enabling apparatus 16 set forth therein is intended for use in electrically coupling fuse element 13 by way of shank 140 to ferrule 12. Apparatus 16 comprises an electrical conducting disk 161 having a center aperture sized to receive and slidably support shank 140 of spring member 14. Electrical conducting loop member 162 is positioned in a plane parallel with conducting disk 161 with a free end 1620 located at the center aperture. Extending radially outward toward an edge of disk 161, loop member 162 is formed along the circumference of disk 161 with end 1621 attached thereto to pretension free end 1620 in engagement with spring member shank 140.

The combination of disk 161 and loop number 162, FIG. 2 of the drawing, is disposed within fuse 1 between ferrule 12 and housing 10 and is located such that disk 161 is adjacent to and in engagement with ferrule 12. An electrical path, FIG. 1, extends from ferrule 11 through fuse element 13 over spring member shank 140 slidably engaged with radial end 1620, FIG. 2, through loop member 162 and disk 161 to ferrule 12. Disk 161 slidably supporting shank 140 and loop member 162 pretensioned in engagement therewith enables shank 140 to slide forward in response to the opening of fuse element 13. The resulting release of spring member 14 moves alarm indicator apparatus 15 into a position to visibly indicate failure of the fuse.

In another embodiment of the invention, set forth in FIG. 4 of the drawing, end ferrule 12 has a stem 121 formed to extend outward from housing 10 along the centerline thereof. Stem 121 is formed with an outer surface for engaging the coils and pretensioning spring 142 of spring member 14. In addition, stem 121 has an end section 1210 drilled and sized to receive and slidably support shank 140 coupled with fuse element 13 along the centerline of housing 10. The fuse apparatus further comprises an electrical conducting planar loop spring 162, FIG. 4, having a radial arm 1620 extended at a right angle across spring member shank 140. Radial arm 1620 is formed into a circular loop positioned in ferrule 12 adjacent housing 10 and in engagement with ferrule 12 to pretension radial arm 1620 into electrical engagement with shank 140.

Fuse 1 has an electrical current path extending, FIG. 1, from ferrule 11 to fuse element 13 and shank 140, FIG. 4, through the connection with radial arm 1620 and loop spring 162 to ferrule 12. Ferrule 12 is formed with stem 121 having an end section 1210 slidably supporting spring member shank 140 so that the opening of fuse element 13 in response to a current overload through the aforementioned current path enables shank 140 to move along the centerline of housing 10 across radial arm 1620 and through stem 121. Movement of shank 140 in response to the opening of fuse element 13 releases compressed spring 142 and operates alarm indicator apparatus 15 to denote failure of the fuse.

SUMMARY

It is obvious from the foregoing that the facility, economy and efficiency of electrical fuses may be substantially increased by an alarm indicating fuse having a low resistance current path intended to reduce the wattage output of the fuse and designed to allow the operation of an alarm indicator to denote failure of the fuse. It is further obvious from the foregoing that fuse apparatus slidably engaging alarm indicator apparatus coupled between one conducting member and a fuse element connected to another conducting member for electrically coupling the fuse element to the one conducting member and for enabling the release of the alarm indicator apparatus upon opening of the fuse element obviates the need for having a high resistance current path through a spring structure of the alarm indicator apparatus.

What is claimed is:

1. A fuse (1) comprising a pair of electrical conducting members (11, 12), a fuse element (13) connected to a first one of said electrical conducting members, and alarm means (14, 15) coupling said fuse element to a second one of said electrical conducting members for indicating failure of said fuse.

CHARACTERIZED IN THAT said fuse further comprises apparatus (16, 121, 162) slidably engaging said alarm means for electrically coupling said fuse element to said second electrical conducting member and for enabling release of said alarm means upon opening of said fuse element.

2. The fuse set forth in claim 1

CHARACTERIZED IN THAT
said electrically coupling and release enabling apparatus comprises
apparatus (161, 121) for slidably supporting said alarm means, and
electrical conducting spring apparatus (162) pretensioned in engagement with said alarm means and said second electrical conducting member for coupling said fuse element to said second electrical conducting member and for enabling release of said alarm means upon opening of said fuse element.

3. A fuse (1) comprising
an insulating housing (10),
a pair of electrical conducting ferrules (11, 12) each secured to one end of said housing,
a fuse element (13) positioned in said housing and connected to a first one of said ferrules, and
alarm means (14, 15) spring coupled between said fuse element and a second one of said ferrules for indicating failure of said fuse;
CHARACTERIZED IN THAT
said fuse further comprises
a conducting disk member (161) disposed between said second ferrule and said housing for slidably supporting said alarm means, and
spring apparatus (162) affixed to said conducting disk member and slidably engaging said alarm means for electrically coupling said fuse element to said second ferrule through said disk member and for enabling release of said alarm means upon opening of said fuse element.

4. A fuse (1) comprising
an insulating housing (10);
a pair of electrical conducting ferrules (11, 12) each secured to one end of said housing;
a fuse element (13) positioned in said housing and electrically coupled to a first one of said ferrules;
a spring member (14) having a shank (140) coupled to said fuse element, said shank extended through a second one of said ferrules and formed through a reverse bend (141) into a pretensioned spring (142) engaging said second ferrule; and
alarm means (15) appended to said spring member for indicating failure of said fuse.
CHARACTERIZED IN THAT
said fuse further comprises
apparatus (16, 121, 162) slidably engaging said spring member shank for electrically coupling said fuse element to said second ferrule and for enabling release of said spring member upon opening of said fuse element to cause said alarm means to denote failure of said fuse.

5. The fuse set forth in claim 4
CHARACTERIZED IN THAT
said electrical coupling and release enabling apparatus comprises
spring apparatus (16, 121, 162) pretensioned in engagement with said spring member shank for electrically coupling said fuse element to said second ferrule and for enabling release of said pretensioned spring member upon opening of said fuse element.

6. The fuse set forth in claim 5
CHARACTERIZED IN THAT
said spring apparatus comprises
an electrical conducting disk member (161) disposed between said second ferrule and said housing for slidably supporting said spring member shank.

7. The fuse set forth in claim 6
CHARACTERIZED IN THAT
said spring apparatus further comprises
an electrical conducting loop spring member (162) extended from a free end (1620) adjacent the center of said disk member and formed along the circumference of said disk member with the other end (1621) attached thereto to pretension the free end in engagement with said spring member shank.

8. The fuse set forth in claim 5
CHARACTERIZED IN THAT
said spring apparatus comprises
an electrical conducting loop spring member (162) having a radial end (1620) extending across said spring member shank and formed into a planar circular loop configuration disposed between said second ferrule and said housing in engagement with said second ferrule to pretension said radial end into electrical engagement with said spring member shank.

9. The fuse set forth in claim 8
CHARACTERIZED IN THAT
said second ferrule comprises
a stem section (121) extended outward from said housing along the centerline thereof and drilled for receiving and slidably supporting said spring member shank and having an outer surface for engaging and compressing said pretensioned spring of said spring member.

10. A fuse (1) comprising;
an insulating housing (10);
a pair of electrical conducting ferrules (11, 12) each secured to one end of said housing;
a fuse element (13) positioned in said housing and electrically coupled to a first one of said ferrules;
a spring member (14) having a shank (140) coupled to said fuse element, said shank extended from said fuse element along the centerline of said housing through a second one of said ferrules and formed through a reverse bend (141) into a pretensioned spring (142) engaging said second ferrule;
an alarm indicator (15) appended to said pretensioned spring for indicating failure of said fuse element, said alarm indicator having both a cap (151) formed to receive said pretensioned spring and a stem (152) attached to said reverse bend of said spring member;
an electrical conducting disk member (161) disposed in said housing adjacent said second ferrule for slidably supporting said spring member shank along the centerline of said housing; and
means (162) slidably engaging said spring member shank for electrically coupling said fuse element through said disk member to said second ferrule and for enabling release of said spring member upon opening of said fuse element to cause said alarm indicator to denote failure of said fuse element.

11. The fuse set forth in claim 10 wherein said electrical coupling and release enabling means comprises
an electrical conducting loop member (162) positioned in a plane parallel with and having a free end (1620) extended outward from the center of said disk member and formed radially along the circumference of said disk member with the other end (1621) attached thereto to pretension the free end in engagement with said spring member shank.

12. A fuse (1) comprising
an insulating housing (10);

a fuse element (13) positioned in said housing;

a spring member (14) having a shank (140) coupled to said fuse element, said shank extended along the centerline of said housing and formed through a reverse bend (141) into a spring section (142) the coils of which enclose a portion of said shank;

a first electrical conducting ferrule (11) coupled to said fuse element and secured to one end of said housing;

a second electrical conducting ferrule (12) secured to another end of said housing, said second ferrule having a stem (121) extended outward from said housing along the centerline thereof formed with an outer surface for engaging the coils and pretensioning said spring section and with an end section (1210) seized for slidably supporting said shank of said spring member along the centerline of said housing; and means (162) disposed between said second ferrule and said housing slidably engaging said spring member shank for electrically coupling said fuse element to said second ferrule and for enabling release of said spring member upon opening of said fuse element to denote failure of said fuse.

13. The fuse set forth in claim 12 wherein said electrical coupling and release enabling means comprises an electrical conducting planar loop spring member (162) having a radial end (1620) extended across said spring member shank at a right angle thereto and formed into a circular loop configuration disposed in said housing adjacent second ferrule and in engagement therewith to pretension said radial end into electrical engagement with said spring member shank.

* * * * *